US008033269B2

(12) United States Patent
Ishimura et al.

(10) Patent No.: US 8,033,269 B2
(45) Date of Patent: Oct. 11, 2011

(54) FUEL INJECTION DEVICE

(75) Inventors: Junichiro Ishimura, Saitama (JP); Tomoyuki Hashimoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 321 days.

(21) Appl. No.: 12/483,865

(22) Filed: Jun. 12, 2009

(65) Prior Publication Data

US 2009/0314257 A1 Dec. 24, 2009

(30) Foreign Application Priority Data

Jun. 18, 2008 (JP) ..... 2008-159266

(51) Int. Cl.
*F02M 59/46* (2006.01)
*F02M 41/16* (2006.01)

(52) U.S. Cl. ..... 123/467; 239/96

(58) Field of Classification Search ..... 123/467, 123/506; 239/88–96
See application file for complete search history.

(56) References Cited

U.S. PATENT DOCUMENTS

| | | | | |
|---|---|---|---|---|
| 5,487,508 | A * | 1/1996 | Zuo | 239/533.5 |
| 5,526,791 | A * | 6/1996 | Timmer et al. | 123/467 |
| 5,538,187 | A | 7/1996 | Mueller et al. | |
| 5,671,715 | A * | 9/1997 | Tsuzuki | 123/467 |
| 5,711,279 | A * | 1/1998 | Green et al. | 123/506 |
| 5,893,350 | A * | 4/1999 | Timms | 123/467 |
| 6,308,689 | B1 | 10/2001 | Augustin | |
| 6,367,453 | B1 * | 4/2002 | Igashira et al. | 123/467 |
| 6,390,066 | B1 * | 5/2002 | Drummer et al. | 123/467 |
| 6,502,555 | B1 * | 1/2003 | Harcombe et al. | 123/467 |
| 6,575,139 | B2 * | 6/2003 | Rodriguez-Amaya et al. | 123/467 |
| 6,655,355 | B2 * | 12/2003 | Kropp et al. | 123/467 |
| 6,725,841 | B1 * | 4/2004 | Boecking | 123/467 |
| 6,802,298 | B2 * | 10/2004 | Yoshimura et al. | 123/467 |
| 6,810,857 | B2 * | 11/2004 | Boehland et al. | 123/467 |
| 7,066,151 | B1 * | 6/2006 | Bos | 123/467 |
| 7,415,969 | B2 * | 8/2008 | Sun et al. | 123/467 |
| 2004/0144366 | A1 * | 7/2004 | Grabandt | 123/446 |

FOREIGN PATENT DOCUMENTS

| | | | |
|---|---|---|---|
| DE | 43 41 546 | A1 | 6/1995 |
| DE | 195 12 270 | A1 | 9/1996 |
| DE | 199 10 589 | A1 | 9/2000 |
| WO | WO-03/004864 | A1 | 1/2003 |
| WO | WO-2005/035975 | A1 | 4/2005 |

* cited by examiner

*Primary Examiner* — Thomas Moulis
(74) *Attorney, Agent, or Firm* — Arent Fox LLP

(57) ABSTRACT

To provide a fuel injection device capable of reducing the amount of fuel discharging to the outside. The fuel injection device is provided with the nozzle body, the injection control valve, and the close assistance piston. In the nozzle body, the first fuel chamber and the nozzle valve close chamber are formed. The injection control valve advances to a first position, thereby allowing the first fuel passage to be communicated with the first fuel chamber and blocking access from the first fuel chamber to the third fuel passage, and the injection control valve retreats to a second position, thereby blocking access from the first fuel passage to the first fuel chamber and allowing the first fuel chamber to be communicated with the third fuel passage. The close assistance piston prevents fuel in the first fuel chamber from discharging to the outside of the fuel injection device.

11 Claims, 9 Drawing Sheets

PRIOR ART

FUEL INJECTION DEVICE

This application is based on and claims the benefit of priority from Japanese Patent Application No. 2008-159266, filed on 18 Jun. 2008, the content of which is incorporated herein by reference.

BACKGROUND OF THE INVENTION

1. Field of the Invention

The present invention is related to a fuel injection device. Specifically, it is related to a fuel injection device used for a diesel engine, injecting fuel supplied at high pressure from a fuel supply source.

2. Related Art

In related art, a fuel injection device injecting fuel has been used for a diesel engine. FIG. 5 is a sectional view of the fuel injection device 101 according to an example of related art. This fuel injection device is provided with the nozzle body 140, the needle valve 110 provided movably forward and rearward in this nozzle body 140, and the injection control valve 120 provided movably forward and rearward in this nozzle body 140 (refer to Germany Patent No. 19512270).

In the nozzle body 140, the first fuel chamber 141, the second fuel chamber 142, the third fuel chamber 143, and the nozzle orifice 145 extending from this second fuel chamber 142 to the outside of the nozzle body 140 are formed. In addition, in the nozzle body 140, the first fuel passage 151 extending from a fuel supply source to the first fuel chamber 141, the second fuel passage 152 extending from the first fuel chamber 141 to the second fuel chamber 142, the third fuel passage 153 extending from the first fuel chamber 141 to the third fuel chamber 143, and the return fuel passage 154 extending from the third fuel chamber 143 to the outside of the nozzle body 140 are formed.

The needle valve 110 can advance and retreat in the second fuel chamber 142, which is biased in the forward direction by the spring 111. This needle valve 110 advances to contact with the needle body, thereby blocking the passage extending from the second fuel chamber 142 to the nozzle orifice 145.

The injection control valve 120 is provided movably forward and rearward in the first fuel chamber 141, the third fuel passage 153, and third fuel chamber 143, which is biased in the rearward direction by the spring 121. This injection control valve 120 retreats to be situated at the first position, thereby allowing the first fuel passage 151 to be communicated with the first fuel chamber 141 and blocking access from the third fuel passage 153 to the third fuel chamber 143. Meanwhile, this injection control valve 120 advances to be situated at the second position, thereby allowing the third fuel passage 153 to be communicated with the third fuel chamber 143 and blocking access from the first fuel passage 151 to the first fuel chamber 141. FIG. 5 shows the state in which the injection control valve 120 is situated at the second position.

According to the above-mentioned fuel injection device 101, when the suppress strength applied to the injection control valve 120 is released, the injection control valve 120 is situated at the first position by the biasing force of the spring 121, and thus fuel supplied from a fuel supply source flows in the second fuel chamber 142 through the first fuel passage 151, the first fuel chamber 141, and the second fuel passage 152. Then, the needle valve 110 retreats to inject fuel, resisting the biasing force of the spring 111 by the pressure of the fuel flowed in the second fuel chamber 142.

Meanwhile, when the injection control valve 120 is pressed to be situated at the second position, fuel stops flowing from the first fuel passage 151 to the first fuel chamber 141, and the fuel already flowed in the first fuel chamber 141, the second fuel passage 152, and the second fuel chamber 142 is discharged to the outside through the third fuel passage 153, the third fuel chamber 143, and the return fuel passage 154. At the same time, the pressure of the fuel flowed in the second fuel chamber 142 decreases, so that the needle valve 110 advances by the biasing force of the spring 111 to contact with the nozzle body to stop fuel injection.

However, the above-mentioned fuel injection device has a problem in which the efficiency is low because the injection control valve is shifted from the first position to the second position to stop the fuel injection operation, which causes most of the fuel already flowed in the nozzle body 140 to be discharged to the outside.

SUMMARY OF THE INVENTION

An objective of the present invention is to provide a fuel injection device capable of reducing the amount of fuel discharging to the outside of a fuel injection device.

The fuel injection device of the present invention (for example, the below-mentioned fuel injection device 1) includes: a nozzle body (for example, the below-mentioned nozzle body 40) in which a first fuel chamber (for example, the below-mentioned first fuel chamber 41), a second fuel chamber (for example, the below-mentioned second fuel chamber 42), a third fuel chamber (for example, the below-mentioned needle valve close chamber 43), and a nozzle orifice (for example, the below-mentioned nozzle orifice 45) extending from the second fuel chamber to the outside of the fuel injection device are formed; a needle valve (for example, the below-mentioned needle valve 10) held in a needle valve holding part (for example, the below-mentioned needle valve holding part 46) in the nozzle body; a needle valve open means (for example, the below-mentioned second fuel chamber 42, the below-mentioned uneven part 13, and the below-mentioned fuel reserve part 421) provided closer to the front end side than the needle valve holding part in the nozzle body, having the second fuel chamber; a needle valve close means (for example, the below-mentioned needle valve close chamber 43 and the below-mentioned close assistance piston 30) provided closer to the rear end side than the needle valve holding part in the nozzle body, having the third fuel chamber; an injection control valve held in the nozzle body, being capable of advancing and retreating in the first fuel chamber (for example, the below-mentioned injection control valve 20), in which in the nozzle body, a first fuel passage (for example, the below-mentioned first fuel passage 51) extending from a fuel supply source to the first fuel chamber, a second fuel passage (for example, the below-mentioned second fuel passage 52) extending from the first fuel chamber to the second fuel chamber, a third fuel passage (for example, the below-mentioned third fuel passage 53) extending from the first fuel chamber to the third fuel chamber, and a fourth fuel passage (for example, the below-mentioned fourth fuel passage 54) extending from the third fuel chamber to a low pressure part at the outside of the fuel injection device are formed, the injection control valve advances to a first position (for example, the below-mentioned first position), thereby allowing the first fuel passage to be communicated with the first fuel chamber and blocking access from the first fuel chamber to the third fuel passage, and the injection control valve retreats to a second position (for example, the below-mentioned second position), thereby blocking access from the first fuel passage to the first fuel chamber and allowing the first fuel chamber to be communicated with the third fuel passage, the needle valve advances to contact with the nozzle body, thereby blocking access from the second fuel chamber to the nozzle orifice, and the needle valve retreats to move apart from the nozzle body, thereby allowing the second fuel chamber to be communicated with the nozzle orifice, the needle valve open means retreats the needle valve by the fuel pressure in the second fuel chamber and the needle valve close means advances the needle valve retreats by the fuel pressure in the third fuel chamber; and a discharge prevention means (for example, the below-mentioned close assistance piston 30 and the below-mentioned needle valve close chamber 43) of preventing fuel in the first fuel chamber from discharging to the outside of the fuel injection device through the third fuel passage, the third fuel chamber, and the fourth fuel passage when the injection control valve shifts from the first position to the second position.

According to this invention, the operation of the fuel injection device is described below. Fuel is supplied from a fuel supply source to the first fuel passage. When the injection control valve is advanced to the first position under this condition, the first fuel passage is communicated with the first fuel chamber, and the first fuel chamber is blocked from access to the third fuel passage. Accordingly, fuel flows from the first fuel passage to the second fuel chamber through the first fuel chamber and the second fuel passage, which leads to the increased pressure of fuel in the second fuel chamber. Then, the needle valve open means operates to retreat the needle valve by the fuel pressure in the second fuel chamber. As a result, fuel in the second fuel chamber is injected from the nozzle orifice.

Meanwhile, when the injection control valve is retreats to the second position, the first fuel passage is blocked from access to the first fuel chamber, and the first fuel chamber is communicated with the third fuel passage. Accordingly, fuel flows from the second fuel passage to the third fuel chamber through the first fuel chamber and the third fuel passage, which leads to the increased pressure of fuel in the third fuel chamber. Then, the needle valve close means operates to advance the needle valve by the fuel pressure in the third fuel chamber. As a result, the needle valve contacts with the nozzle body to stop fuel injection.

When this injection control valve shifts from the first position to the second position, fuel in the second fuel passage flows in the first fuel chamber, and the discharge prevention means prevents fuel in the first fuel chamber from discharging to the outside of the fuel injection device through the third fuel passage, the third fuel chamber, and the fourth fuel passage. Thus, the amount of fuel discharging to the outside can be reduced, so that the efficiency of the entire fuel supply system can be improved.

In this case, it is preferable that the needle valve close means is provided with a close assistance piston (for example, the below-mentioned close assistance piston 30) provided movably forward and rearward in the third fuel chamber; the close assistance piston blocks access from the third fuel passage to the third fuel chamber at a most retreated position (the below-mentioned most retreated position) and allows the third fuel passage to be communicated with the third fuel chamber by shifting to the advanced state; the third fuel chamber is divided into the close assistance pressure chamber (for example, the below-mentioned close assistance pressure chamber 432) communicated with the third fuel passage and the return pressure chamber (the below-mentioned return pressure chamber 433) communicated with the fourth fuel passage by the close assistance piston, in the advanced state of the close assistance piston; the close assistance piston is capable of transmitting the suppress strength generated by the fuel pressure in the close assistance pressure chamber in the forward direction to the needle valve; and the close assistance piston is the discharge prevention means of preventing fuel in the first fuel chamber from discharging to the outside of the fuel injection device by shifting from the advanced state to the most retreated position to block access from the third fuel passage to the close assistance pressure chamber, thereby preventing fuel in the first fuel chamber from flowing in the third fuel chamber through the third fuel passage.

According to the present invention, the close assistance piston transmits the suppress strength generated by the fuel pressure in the close assistance pressure chamber in the forward direction to the needle valve to advance this needle valve, resulting in the stop of fuel injection. Therefore, the closing velocity of the needle valve can be improved, which can improve the build down characteristic of the fuel injection pressure.

In this case, it is preferable that, in the third fuel chamber, the rear end side of the needle valve is exposed, the needle valve close means is further provided with an elastic member (for example, the below-mentioned spring 31) that is provided between the close assistance piston and the rear end side of the needle valve and biases the close assistance piston and the needle valve in the direction in which the close assistance piston and the needle valve move apart from each other, and the close assistance piston is biased to the most retreated position by the elastic member.

According to the present invention, the elastic member biasing the close assistance piston and the needle valve in the direction in which the close assistance piston and the needle valve move apart from each other is provided to bias the close assistance piston to the most retreated position. Thus, the close assistance piston is promptly retreated to the most retreated position, which can block the communication of the third fuel passage with the close assistance pressure. Therefore, the flow through the fourth fuel passage can be reduced.

In this case, it is preferable that, in the close assistance piston, a micro communication passage (for example, the below-mentioned micro communication passage 331) allowing the close assistance pressure chamber to be communicated with the return pressure chamber is formed.

According to the present invention, the close assistance piston is provided with the micro communication passage. Thus, fuel in the close assistance pressure chamber is introduced into the return pressure chamber through the micro communication passage, which can smoothly retreat the close assistance piston to the most retreated position. Therefore, the flow through the fourth fuel passage can be reduced.

In this case, it is preferable that the micro communication passage is formed between the close assistance piston and the third fuel chamber by denting a part of the outer circumferential face of the close assistance piston.

The out edge of the close assistance piston is processed easily more than the inner side. According to this invention, the micro communication passage is formed by denting a part of the outer circumferential face of the close assistance piston, so that the sectional area of the micro communication passage can be managed with a high degree of accuracy.

In this case, it is preferable that the close assistance piston is provided with an assistance force transmission part (for example, the assistance force transmission part 32) projecting in a rod shape from the end part of the needle valve side; the needle valve is provided with a needle valve main body (for example, the below-mentioned needle valve main body 11) with a rod shape, and a movement restriction part (for example, the below-mentioned movement restriction part 12) formed in a flange shape at the rear end side of the needle valve main body, restricting the needle valve from retreating;

the needle valve advances when the assistance force transmission part of the close assistance piston presses the rear end side of the needle valve; and a space is formed between the close assistance piston and the needle valve when the close assistance piston retreats to the most retreated position, even if the needle valve retreats until the movement restriction part restricts the needle valve from retreating.

According to the present invention, so as to form a space between the close assistance piston and the needle valve when the close assistance piston retreats to the most retreated position, even if the needle valve retreats until the movement restriction part restricts the needle valve from retreating, the movement stroke and the length of the close assistance piston and the needle valve are determined. Accordingly, the needle valve has no contact with the close assistance piston when the needle valve is retreated to inject fuel, so that the durability of the close assistance piston can be improved, and the outer diameter of the assistance force transmission part of the close assistance piston can be reduced.

In this case, it is preferable that the force by which the needle valve close means advances the needle valve is greater than that by which the needle valve open means retreats the needle valve when the injection control valve retreats from the first position to allow the second fuel passage to be communicated with the third fuel passage so that the fuel pressure in the second fuel chamber is equal to that in the third fuel chamber.

According to the present invention, the force by which the needle valve close means advances the needle valve is greater than that by which the needle valve open means retreats the needle valve when the fuel pressure in the second fuel chamber is equal to that in the third fuel chamber. Thus, the fuel pressure in the second fuel chamber is applied in the direction in which the needle valve advances when the fuel injection stops, so that the fuel injection can be stopped promptly. Therefore, the response time from the retreat of the injection control valve to the stop of the fuel injection can be shortened. As a result, the least injection time can be shortened, and the minimum injection amount can be reduced, so that a variety of injection methods can be achieved.

In this case, it is preferable that the area of the pressure receiver for the fuel pressure which the needle valve close means receives from the third fuel chamber is greater than that of the pressure receiver for the fuel pressure which the needle valve open means receives from the second fuel chamber.

In this case, it is preferable that the maximum diameter of the pressure receiver for the fuel pressure which the needle valve close means receives from the third fuel chamber is greater than that for the pressure receiver for the fuel pressure which the needle valve open means receives from the second fuel chamber.

In this case, it is preferable that the needle valve open means consists of the second fuel chamber and an uneven part circularly formed along the outer circumference of the front end side of the needle valve, and the maximum diameter of the close assistance piston is greater than that of the uneven part of the needle valve open means.

The fuel injection device of the present invention includes: a nozzle body in which a first fuel chamber is formed; an injection control valve held in the nozzle body, being capable of advancing and retreating in the first fuel chamber, in the nozzle body, a first fuel passage extending from a fuel supply source to the first fuel chamber, a injected-fuel passage (for example, the below-mentioned second fuel passage 52 and the below-mentioned second fuel chamber 42) extending from the first fuel chamber to the nozzle orifice, and a return fuel passage (for example, the below-mentioned third fuel passage 53, the below-mentioned needle valve close chamber 43, and the below-mentioned fourth fuel passage 54) extending from the first fuel chamber to a low pressure part at the outside of the fuel injection device are formed, the injection control valve advances to a first position, thereby allowing the first fuel passage to be communicated with the first fuel chamber and blocking access from the injected-fuel passage to the return fuel chamber, and the injection control valve retreats to a second position, thereby blocking access from the first fuel passage to the first fuel chamber and allowing the injected-fuel passage to be communicated with the return fuel passage; and a discharge prevention means of preventing fuel in the first fuel chamber from discharging to the outside of the fuel injection device through the return fuel passage when the injection control valve shifts from the first position to the second position.

According to the present invention, when the injection control valve shifts from the first position to the second position, fuel in the first fuel chamber is prevented from discharging to the outside of the fuel injection device through the third fuel passage, the third fuel chamber, and the fourth fuel passage. Thus, the amount of fuel discharging to the outside can be reduced, so that the fuel efficiency of the entire fuel supply system can be improved.

DETAILED DESCRIPTION OF THE INVENTION

Figure 1:
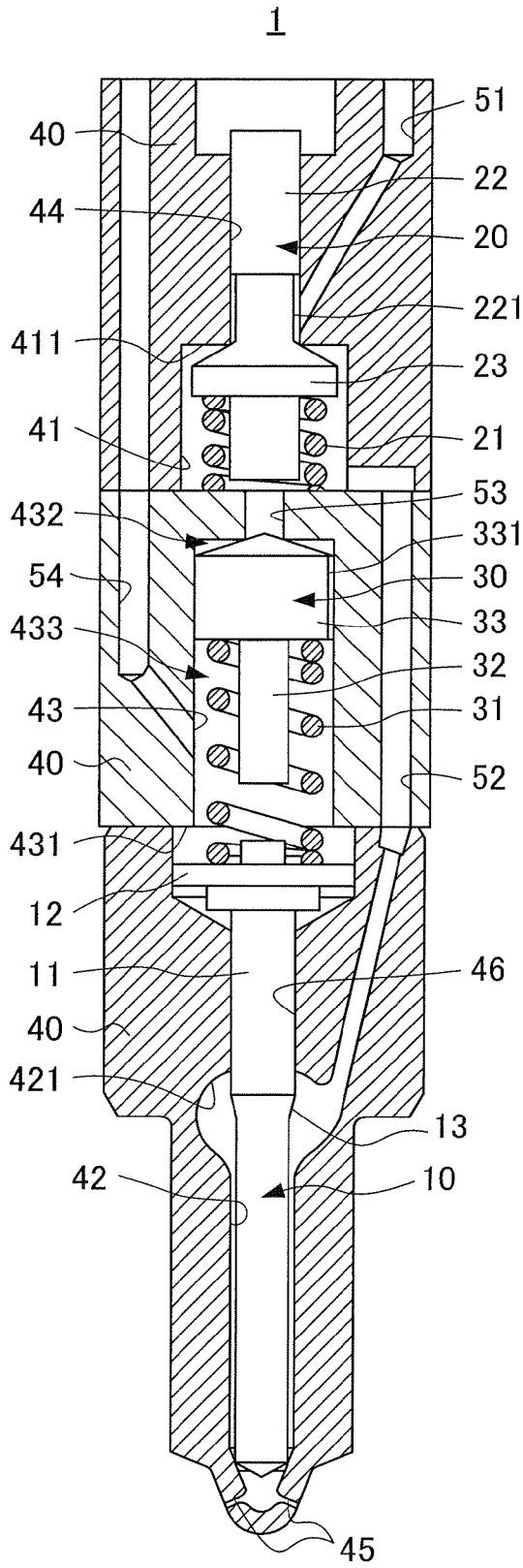
FIG. 1 is a sectional view illustrating the structure of the fuel injection device according to one embodiment of the present invention.

One embodiment of the present invention is described based on the accompanying drawings. FIG. 1 is a sectional view illustrating the structure of the fuel injection device 1 according to one embodiment of the present invention. In FIGS. 1-4, the movement stroke amounts and the sizes of the needle valve 10, the injection control valve 20, and the close assistance piston 30 are enlarged to show detail for easy understanding.

The fuel injection device 1 is accommodated in a housing (not shown), which injects fuel supplied at high pressure from a fuel supply source in accordance with the operation of an actuator (not shown). This fuel injection device 1 is provided with the needle valve 10 the injection control valve 20, the spring 21 biasing this injection control valve, the close assistance piston 30 as the needle valve close means, the spring 31 as the elastic member biasing this close assistance piston 30, and the cylindrical nozzle body 40 accommodating these elements.

The nozzle body 40 consists of three members. In this nozzle body 40, the first fuel chamber 41, the needle valve close chamber 43 as the needle valve close means and the third fuel chamber, and the second fuel chamber 42 as the needle valve open means are formed sequentially from the rear end side to the front end side.

In addition, in the nozzle body 40, the first fuel passage 51 extending from a fuel supply source (not shown) to the first fuel chamber 41, the second fuel passage 52 extending from the first fuel chamber 41 to the second fuel chamber 42, the third fuel passage 53 extending from the first fuel chamber 41 to the needle valve close chamber 43, and the fourth fuel passage 54 extending from the needle valve close chamber 43 to a low pressure part (not shown) at the outside of the nozzle body 40 are formed. For example, the fuel supply source includes a high pressure pump connected through a common-rail. For example, the low pressure part includes a fuel tank, a fuel passage between a low pressure pump and a high pressure pump, a fuel passage closer to the upstream side than a compressing chamber in the high pressure pump, and the like.

The first fuel chamber 41 is an approximately cylindrical space extending along the direction in which the nozzle body 40 extends. In the rear end face of this first fuel chamber 41, a through-hole, the cross section of which is a circle shape, extending to the rear end face of the nozzle body 40 is formed. This through-hole is the injection control valve holding part 44 holding the injection control valve 20. The inner diameter of the injection control valve holding part 44 is smaller than that of the first fuel chamber 41, by which the uneven part 411 is formed at the rear end face of the first fuel chamber 41.

The first fuel passage 51 extends from the rear end face of the nozzle body 40 to the inner circumferential face around the front end side of the through-hole which is the injection control valve holding part 44.

The needle valve close chamber 43 is an approximately cylindrical space extending along the direction in which the nozzle body 40 extends. At the front end side of this needle valve close chamber 43, the uneven part 431 is formed along the circumferential direction. The third fuel passage 53 is a through-hole extending from the approximate center of the front end face of the first fuel chamber 41 to the approximate center of the rear end face of the needle valve close chamber 43. The fourth fuel passage 54 extends from the inner circumferential face around the front end side of the needle valve close chamber 43 to the rear end face of the nozzle body 40.

The second fuel chamber 42 is an approximately cylindrical space extending along the direction in which the nozzle body 40 extends. At the front end side of this second fuel chamber 42, a through-hole extending to the outside of the nozzle body 40 is formed. This through-hole is the nozzle orifice 45. At the rear end side in the direction in which the second fuel chamber 42 extends, the fuel reserve part 421 as the needle valve open means with the enlarged inner circumference is formed.

In the nozzle body 40, a through-hole extending from the needle valve close chamber 43 to the second fuel chamber 42 is formed. This through-hole is the needle valve reserve part 46 holding the needle valve 10. The second fuel passage 52 extends from the inner circumferential face closer to the front end side than the uneven part 411 of the first fuel chamber 41 to the fuel reserve part 421 of the second fuel chamber 42.

The needle valve 10 is held in the needle valve holding part 46 of the nozzle body 40. The front end side of this needle valve 10 can advance and retreat in the second fuel chamber 42, along the direction in which the second fuel chamber 42 extends. The needle valve 10 is provided with the cylindrical needle valve main body 11 slidably held in the needle valve holding part 46, and the movement restriction part 12 formed in a flange shape at the rear end side of this needle valve main body 11.

The rear end side of the needle valve main body 11 is exposed in the needle valve close chamber 43 more than the needle valve holding part 46 of the needle valve main body 11. The movement restriction part 12 is formed in a part of the needle valve main body 11, which is exposed in the needle valve close chamber 43.

The outer diameter of the movement restriction part 12 of the needle valve 10 is greater than the inner diameter closer to the part at the rear end side than the uneven part 431 of the needle valve close chamber 43. Therefore, when the needle valve 10 retreats, the movement restriction part 12 reaches to the uneven part 431, thereby preventing the needle valve 10 from retreating any further.

At the part of the outer circumferential face of the needle valve main body 11, which is located in the vicinity of the fuel reserve part 421, the uneven part 13 as the needle open means is circularly formed along the circumferential direction. The outer diameter closer to the part at the front end side than the uneven part 13 of the needle valve main body 11 is smaller than that close to the part at the rear end side than the uneven part 13 of the needle valve main body 11. A space in which fuel circulates is formed between the outer diameter closer to the part at the front end side than the uneven part 13 of the needle valve main body 11 and the inner circumferential face of the second fuel chamber 42.

In above-mentioned needle valve 10, the front end face of the needle valve main body 11 moves apart from the front end side of the second fuel chamber 42, thereby allowing the fuel reserve part 421 of the second fuel chamber 42 to be communicated with the nozzle orifice 45, and the front end face of the needle valve main body 11 contacts with the front end side of the second fuel chamber 42, thereby blocking access from the fuel reserve part 421 of the second fuel chamber 42 to the nozzle orifice 45.

The injection control valve 20 is held in the injection control valve holding part 44 of the nozzle body 40, which can advance and retreat in the first fuel chamber 41 by a piezo type of an actuator (not shown), along the direction in which the first fuel chamber 41 extends. The injection control valve 20 is provided with the cylindrical injection control valve main body 22, and the passage close part 23 formed in a flange shape in this injection control valve main body 22. The passage close part 23 is formed at the part of the injection control valve main body 22, which is exposed in the first fuel chamber 41. The injection control valve main body 22 is slidably held in the injection control valve holding part 44. In a part of the outer circumferential face of this injection control valve main body 22, from the part opposed to the first fuel passage 51 to the passage close part 23, the reduced diameter part 221 is formed.

The spring 21 is provided between the front end face of the first fuel chamber 41 and the passage close part 23 of the injection control valve 20, biasing the injection control valve 20 in the retreating direction.

The condition in which the above-mentioned injection control valve 20 advances, resisting the biasing force of the spring 21, and the front end face of the injection control valve main body 22 contacts with the front end face of the first fuel chamber 41, is defined as the first position of the injection control valve 20. The injection control valve 20 is situated at the first position, the front end face of the injection control valve main body 22 contacts with the front end face of the first fuel chamber 41, and a space is formed between the passage close part 23 and the uneven part 411 of the first fuel chamber 41.

The first fuel passage 51 is communicated with the front end side of the through-hole which is the injection control valve holding part 44, and the third fuel passage 53 is communicated with the front end face of the first fuel chamber 41. In this condition, the first fuel chamber 41 is blocked from access to the third fuel passage 53, and the first fuel passage 51 is communicated with the first fuel chamber 41.

Meanwhile, the condition in which the injection control valve 20 retreats, and the passage close part 23 contacts with the uneven part 411 of the first fuel chamber 41 is defined as the second position of the injection control valve 20. When the injection control valve 20 is situated at the second position, the front end face of the injection control valve main body 22 moves apart from the front end face of the first fuel chamber 41, thereby forming a space with the passage close part 23 contacting with the uneven part 411 of the first fuel chamber 41. Under this condition, the first fuel passage 51 is blocked from access to the first fuel chamber 41, and the first fuel chamber 41 is communicated with the third fuel passage 53. FIG. 1 shows the state in which the injection control valve 20 is situated at the second position.

The close assistance piston 30 is provided movably forward and rearward in the nozzle valve close chamber 43, which is provided with the approximately cylindrical partition part 33 sliding on the inner wall face of the nozzle valve close chamber 43, and the assistance force transmission part 32 projecting in a rode shape from the end part at the needle valve 10 side of this partition part 33.

The needle valve close chamber 43 is divided into the close assistance pressure chamber 432 communicated with the third fuel passage 53 and the return pressure chamber 433 communicated with the fourth fuel passage 54 by the partition part 33.

The part at the rear end side of the partition part 33 has an approximately conical shape, projecting toward the third fuel passage 53. In the partition part 33, the micro communication passage 331 communicating the close assistance pressure chamber 432 with the return pressure chamber 433 is formed. This micro communication passage 331 is formed between the close assistance piston 30 and the needle valve close chamber 43 by denting the outer circumferential face of the partition part 33 of the close assistance piston 30.

The spring 31 is provided between the close assistance piston 30 and the needle valve 10 in the needle valve close chamber 43, biasing the close assistance piston 30 and the needle valve 10 in the direction in which the close assistance piston 30 and the needle valve 10 move apart from each other.

The above-mentioned close assistance piston 30 operates as described below. Specifically, the injection control valve 20 is first situated at the first position, thereby blocking access from the first fuel chamber 41 to the third fuel passage 53, and the spring 31 biases the close assistance piston 30 to the most retreated position, and the conical part of the partition part 33 blocks the third fuel passage 53 at the rear end face of the nozzle valve close chamber 43. Under this condition, the close assistance piston 30 is situated at the most retreated position.

In this case, the conical part of the partition part 33 blocks the third fuel passage 53, thereby blocking access from the third fuel passage 53 to the close assistance pressure chamber 432. In addition, under this condition, so as to form a space between the front end face of the assistance force transmission part 32 of the close assistance piston 30 and the rear end face of the needle valve 10 even if the needle valve 10 retreats until the movement restriction part 12 restricts the needle valve 10 from retreating, the movement stroke and the length of the close assistance piston 30 and the needle valve 10 are determined.

Accordingly, when the injection control valve 20 retreats from the first position, the first fuel chamber 41 is communicated with the third fuel passage 53, and thus fuel in the first fuel chamber 41 flows in the third fuel passage 53. Then, the second fuel passage 52 is communicated with the third fuel passage 53, and thus fuel in the second fuel passage 52 flows in the third fuel passage 53. Subsequently, the close assistance piston 30 advances, resisting the biasing force of the spring 21 by the fuel pressure in this third fuel passage 53, and the front end face of the assistance force transmission part 32 contacts with the rear end face of the needle valve 10.

Under this condition, fuel in the third fuel passage 53 flows in the close assistance pressure chamber 432 of the nozzle valve close chamber 43, so that the fuel pressure in the fuel reserve part 421 of the second fuel chamber 42 is equal to that in the close assistance pressure chamber 432 of the needle valve close chamber 43. Then, the conical part of the partition part 33 of the close assistance piston 30, as the pressure receiver, receives the fuel pressure from the close assistance pressure chamber 432, thereby applying force to the needle valve 10 in the direction of advancing the needle valve 10 through the close assistance piston 30. At the same time, the circular uneven part 13 of the needle valve 10, as the pressure receiver, receives the fuel pressure from the fuel reserve part 421, thereby applying force to the needle valve 10 in the rearward direction.

At this time, the maximum diameter of the partition part 33 of the close assistance piston 30 is greater than that of the uneven part 13 of the needle valve 10, and the area of the pressure receiver of the partition part 33 of the close assistance piston 30 is greater than that of the uneven part 13 of the needle valve 10. Therefore, the force for advancing the close assistance piston 30 is greater than that for retreating the needle valve 10, thereby pressing the rear part side of the needle valve 10 by the front end face of the assistance force transmission part 32 to advance the needle valve 10.

Figure 2A:
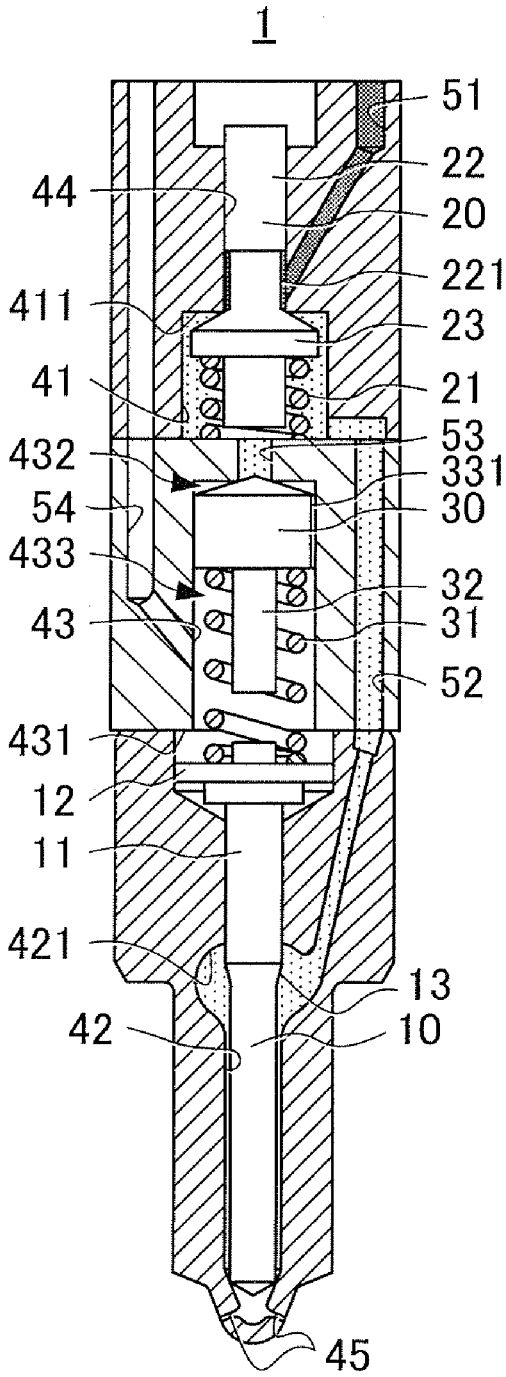
FIGS. 2A-2C are diagrams (I) for explaining the operation of the fuel injection device according to the embodiment.

The operation of the fuel injection device 1 is described below with reference to FIGS. 2A-4. The first step is the initial state as shown in FIG. 2A. Specifically, fuel is supplied at high pressure from a fuel supply source to the first fuel passage 51, and the injection control valve 20 retreats to be situated at the second position by the biasing force of the spring 21. Accordingly, the passage close part 23 of the injection control valve 20 contacts with the uneven part 411 of the first fuel chamber 41, so that a high pressure of fuel in the first fuel passage 51 remains the space between the reduced diameter part 221 of the injection control valve 20 and the inner circumferential face of the injection control valve holding part 44.

In addition, the needle valve 10 advances to contact with the front end side of the second fuel chamber 42, by the biasing force of spring 31, and the close valve assistance piston 30 retreats to be situated at the most retreated position, closing the third fuel passage 53. Therefore, fuel flowed by the last injection operation is confined at a certain level of pressure in the second fuel chamber 42, the second fuel passage 52, the first fuel chamber 41, and the third fuel passage 53.

Figure 2B:
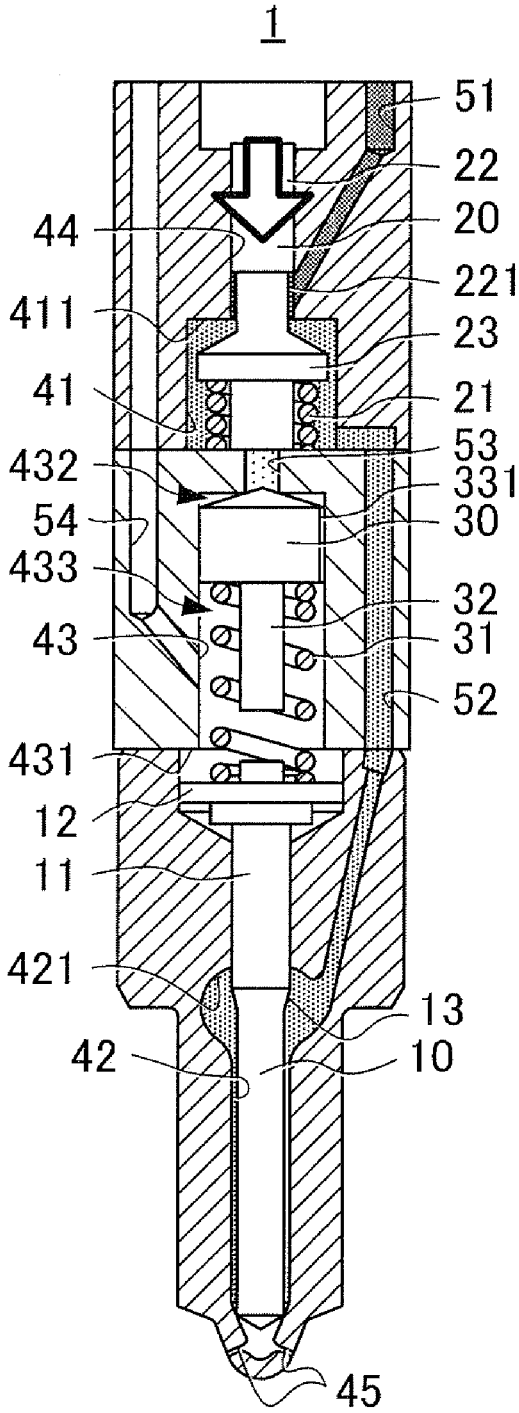

In the second step, when the actuator (not shown) is driven under this condition, the injection control valve 20 advances to be situated at the first position, resisting the biasing force of the spring 21, as shown in FIG. 2B.

Then, the front end face of the injection control valve main body 22 contacts with the front end face of the first fuel chamber 41, thereby blocking access from the first fuel chamber 41 to the third fuel passage 53. Thus, a high pressure of fuel is blocked from being supplied to the third fuel passage 53. In addition, the passage close part 23 moves apart from the uneven part 411 of the first fuel chamber 41 to form a space between the passage close part 23 and the uneven part 411 of the first fuel chamber 41. Thus, a high pressure of fuel in the first fuel passage 51 flows in the fuel reserve part 421 of the second fuel chamber through the space between the reduced diameter part 211 of the injection control valve 20 and the inner circumferential face of the fuel control valve holding part 44, the first fuel chamber 41, and the second fuel passage 52. As described above, fuel in this fuel reserve part 421 already has a certain level of pressure. Under this condition, when a high pressure of fuel in the first fuel passage 51 is supplied in the fuel reserve part 421, the fuel pressure in the second fuel chamber 42 increases.

Figure 2C:
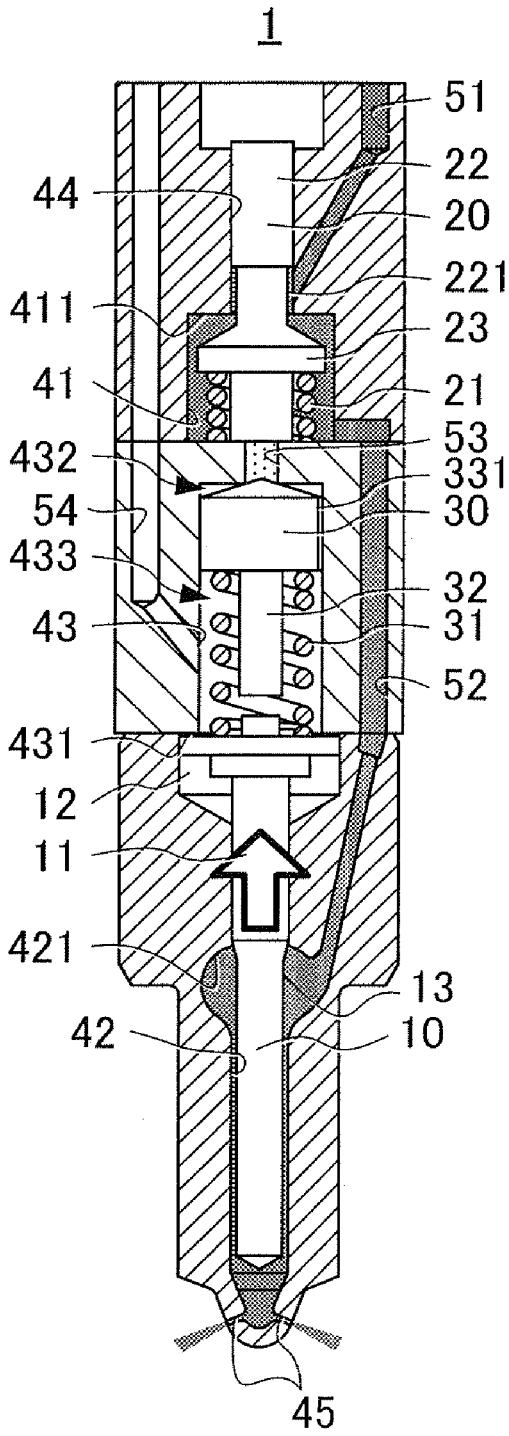

In the third step, when the fuel pressure in the fuel reserve part 421 reaches a predetermined pressure, the needle valve 10 retreats, resisting the spring 31 by the fuel pressure in this fuel reserve part 421, until the movement restriction part 12 of the needle valve 10 contacts with the uneven part 431, as shown in FIG. 2C. Therefore, the needle valve 10 moves apart from the front end side of the second fuel chamber 42 to inject fuel from the second fuel chamber 42 through the nozzle orifice 45.

Figure 3A:
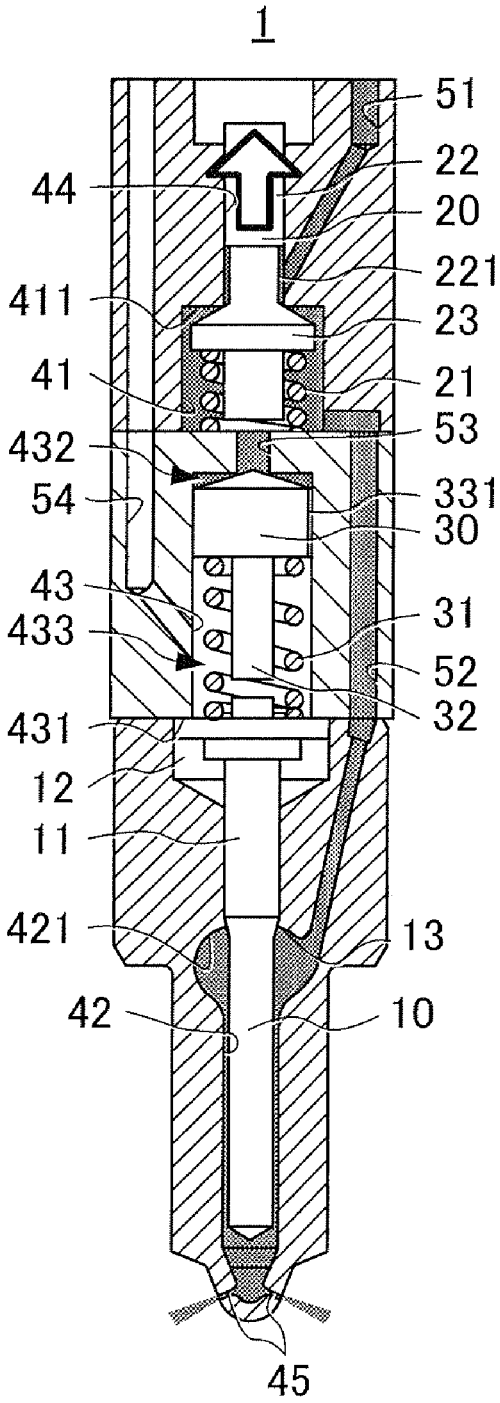
FIGS. 3A-3C are diagrams (II) for explaining the operation of the fuel injection device according to the embodiment.

In the fourth step, the actuator (not shown) stops being driven to release the stress strength to the injection control valve 20. Then, the injection control valve 20 retreats to be situated at the second position by the biasing force of the spring 21, as shown in FIG. 3A. Subsequently, the passage close part 23 contacts with the uneven part 411 of the first fuel chamber 41 to close the injection control holding part 44. Thus, the first fuel passage 51 is blocked from access to the first fuel chamber 41, and the first fuel chamber 41 is communicated with the third fuel passage 53. Accordingly, fuel in the first fuel chamber 41 flows in the third fuel passage 53 through the space between the front end face of the injection control valve main body 22 and the front end face of the first fuel chamber 41, thereby increasing the fuel pressure in the third fuel passage 53. Under this condition, the close assistance piston 30 is situated at the most retreated position, and thus the partition part 33 blocks the third fuel passage 53. However, the part of the conical part of this partition part 33, which is exposed in the third fuel passage 53, is pressed to advance the close assistance piston 30.

Figure 3B:
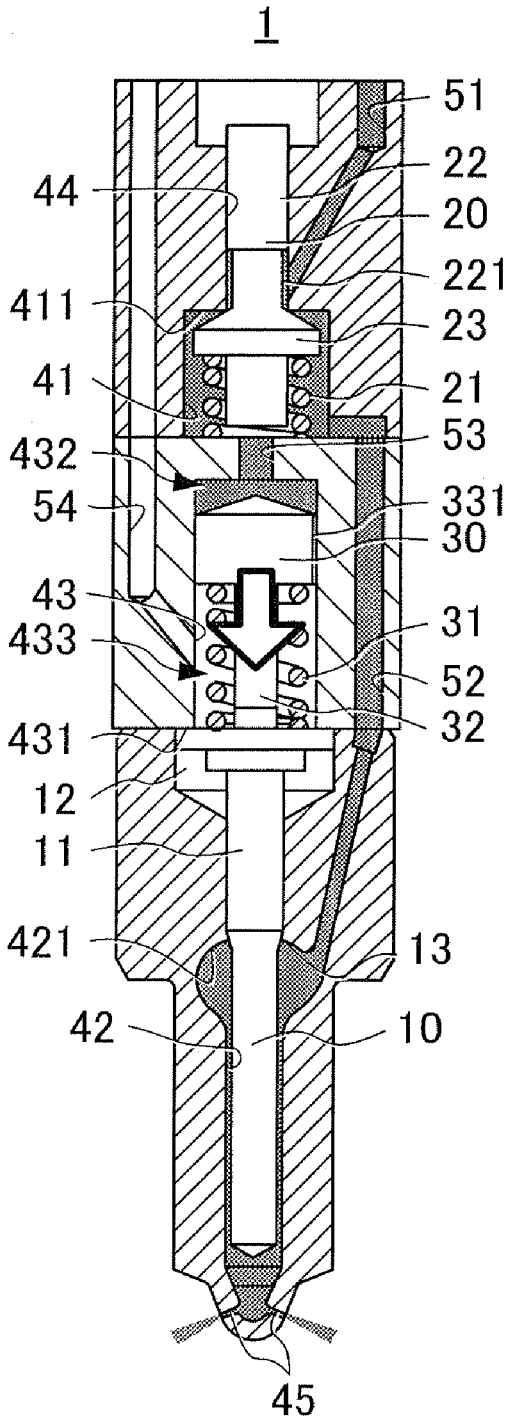

As shown in FIG. 3B, in the fifth step, the close assistance piston 30 advances, and thus the partition part 33 releases the closed third fuel passage 53. Accordingly, fuel flowed in the third fuel passage 53 flows in the close assistance chamber 432 of the needle valve close chamber 43, thereby increasing the pressure in the close assistance chamber 432. When the pressure in the close valve assistance pressure chamber 432 reaches a predetermined pressure, the entire conical part of this partition part is pressed by the pressure of fuel flowed in the close assistance pressure chamber 432 to advance the close assistance piston 30. Thus, the front end face of the assistance force transmission part 32 of this close valve assistance piston 30 contacts with the rear end face of this nozzle valve 10.

Figure 3C:
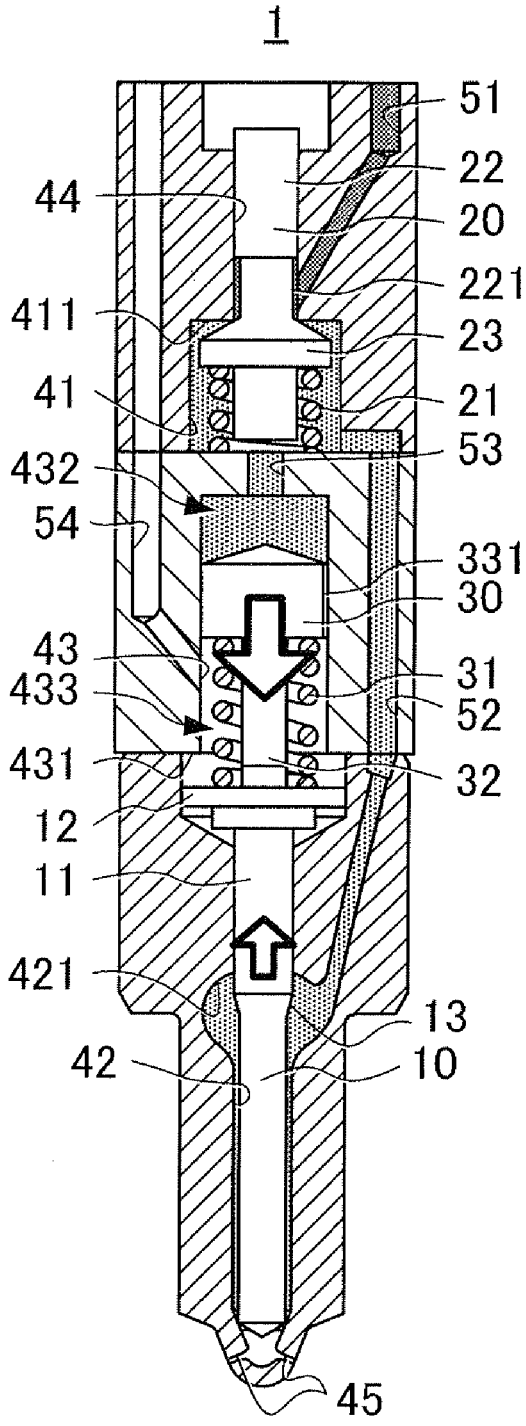

In the sixth step, fuel in the close assistance pressure chamber 432 presses the partition part 33, as shown in FIG. 3C. At this time, the force applied in the direction of advancing the close assistance piston 30 is greater than that applied in the direction in which fuel in the fuel reserve part 421 of the second fuel chamber 42 presses the uneven part 13 to retreat the needle valve 10. Therefore, the close valve assistance piston 30 advances together with the needle valve 10, and the needle valve 10 contacts with the front end side of the second fuel chamber 42 to stop injecting fuel from the nozzle orifice 45.

Figure 4:
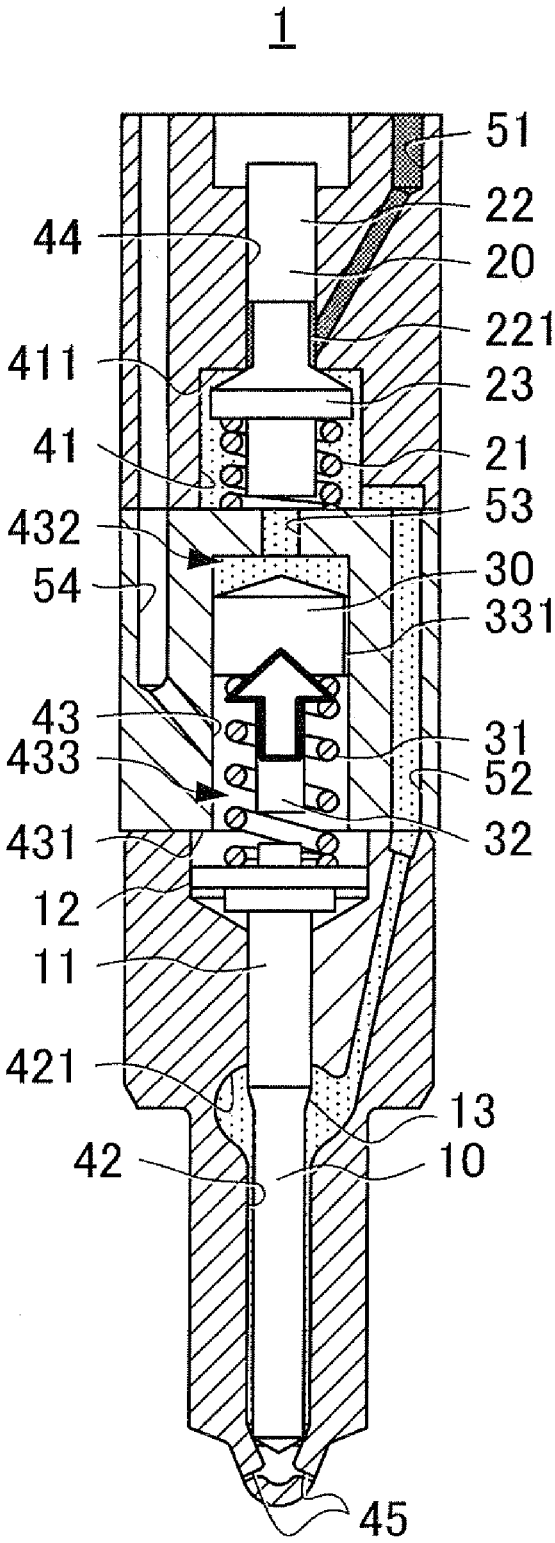
FIG. 4 is a diagram (III) for explaining the operation of the fuel injection device according to the embodiment.
Figure 5:
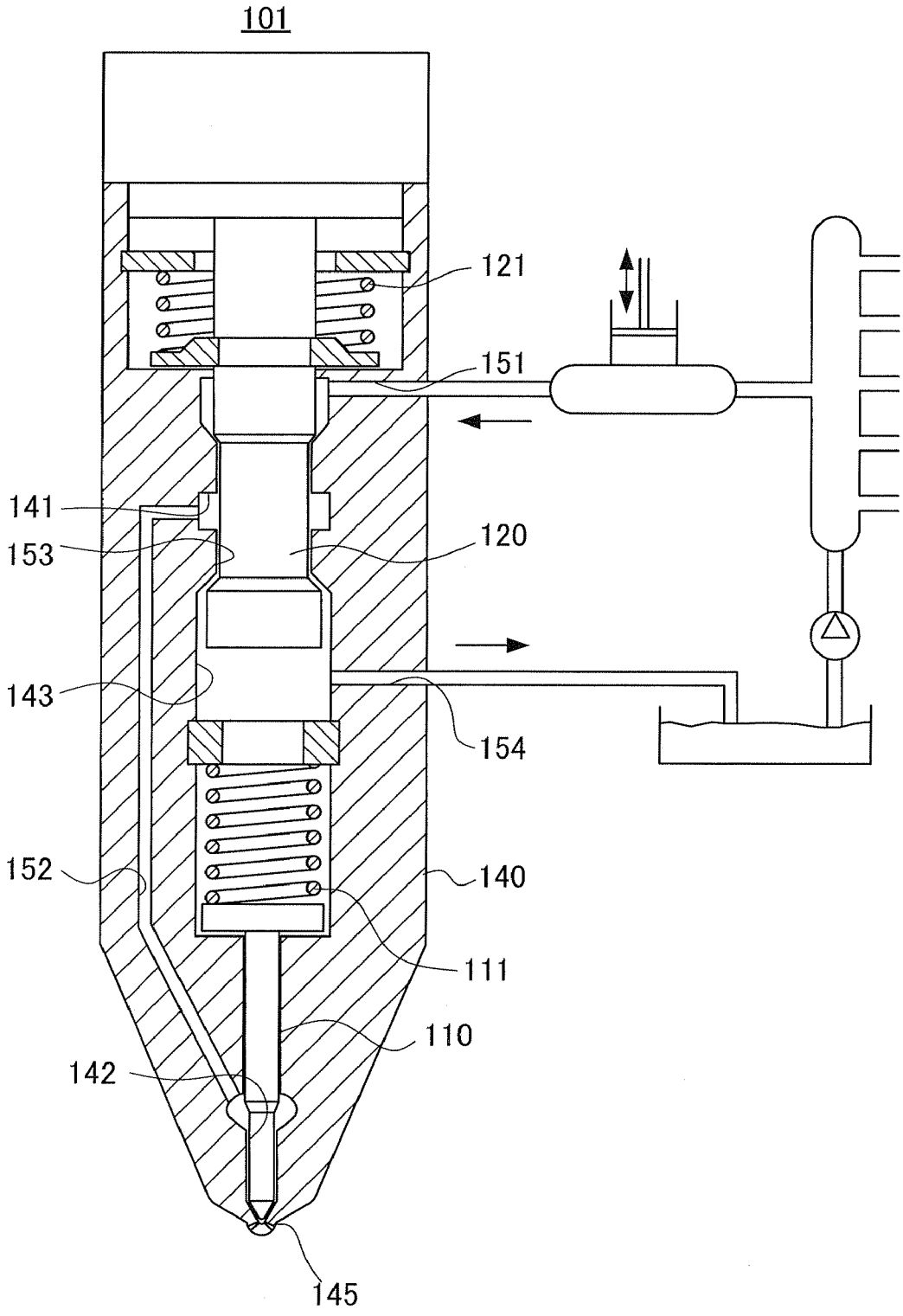
FIG. 5 is a sectional view illustrating the structure of the fuel injection device according to an example of related art of the present invention.

In the seventh step, fuel in the close valve assistance pressure chamber 432 flows little by little to the return pressure chamber 433 through the micro communication passage 331 formed in the partition part 33, and the fuel flowed to this return pressure chamber 433 is discharged to the outside of the nozzle body 40 through the fourth fuel passage 54, as shown in FIG. 4. Accordingly, the pressure in the close valve assistance pressure chamber 432 decreases little by little. Then, when the pressure in the close valve assistance pressure chamber 432 becomes less than a predetermined pressure, the close assistance piston 30 retreats to the most retreated position by the basing force of the spring 31. Therefore, fuel flowed by the last injection operation is confined at a certain level of pressure in the second fuel chamber 42, the second fuel passage 52, the first fuel chamber 41, and the third fuel passage 53, and the operation of the fuel injection device 1 returns to the initial condition.

The present embodiment has the following effects.

(1) When the injection control valve 20 shifts from the first position to the second position, fuel in the first fuel chamber 41 flows in the third fuel passage 53, and the close assistance piston 30 and the needle valve close chamber 43 prevents fuel in the first fuel chamber 41 from discharging to the outside of the fuel injection device 1 through the third fuel passage 53, the close assistance pressure chamber 43, and the fourth fuel passage 54. Thus, the amount of fuel discharging to the outside of the fuel injection device 1, so that the fuel efficiency of the entire fuel supply system can be improved.

(2) The close assistance piston 30 transmits the suppress strength generated by the fuel pressure in the close assistance pressure chamber 43 in the forward direction to the needle valve 10 to advance this needle valve 10, resulting in the stop of fuel injection. Therefore, the closing velocity of the needle valve 10 can be improved, which can improve the build down characteristic of the fuel injection pressure.

(3) The spring 31 biasing the close assistance piston 30 and the needle valve 10 in the direction in which the close assistance piston 30 and the needle valve 10 move apart from each other is provided to bias the close assistance piston 30 to the most retreated position. Thus, the close assistance piston 30 is promptly retreated to the most retreated position, which can block the communication of the third fuel passage 53 with the close assistance pressure chamber 43. Therefore the flow through the fourth fuel passage 54 can be reduced.

(4) The close assistance piston 30 is provided with the micro communication passage 331. Thus, fuel in the close assistance pressure chamber 43 is flowed in the return pressure chamber 433 through the micro communication passage 311. Thus, the close assistance piston 30 can smoothly retreat to the most retreated position, so that the flow through the fourth fuel passage 54 can also be reduced.

(5) The micro communication passage 331 is formed by denting the outer circumferential face of the partition part 33 of the close assistance piston 30, so that the sectional area of the micro communication passage 331 can be managed with a high degree of accuracy.

(6) So as to form a space between the close assistance piston 30 and the needle valve 10 when the close assistance piston 30 retreats to the most retreated position, even if the needle valve 10 retreats until the movement restriction part 12 restricts the needle valve 10 from retreating, the movement stroke and the length of the close assistance piston 30 and the needle valve 10 are determined. Therefore, the needle valve 10 has no contact with the close assistance piston 30 when the needle valve 10 is retreated to inject fuel, so that the durability of the close assistance piston 30 can be improved, and the outer diameter of the assistance force transmission part 32 of the close assistance piston 30 can be reduced.

(7) The force for advancing the needle valve 10 by the fuel pressure acting the close assistance piston 30 is greater than that for retreating the needle valve 10 by the fuel pressure acting the uneven part 13 when the fuel pressure in the second fuel chamber 42 is equal to that in the needle valve close chamber 43. Thus, the fuel pressure is applied in the direction of advancing the needle valve 10 when the fuel injection stops, so that the fuel injection can be stopped promptly. Therefore, the response time from the retreat of the injection control valve 20 to the stop of the fuel injection can be shortened. As a result, the least injection time can be shortened, and the minimum injection amount can be reduced, so that a variety of injection methods can be achieved.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims. For example, the injection control valve 20 is driven by a piezo type of an actuator in the present embodiment, but is not limited thereto. The injection control valve 20 may be driven by an electromagnetic actuator or a hydraulic actuator. In addition, in the present embodiment, the micro communication passage 311 is formed by denting the outer circumferential face of the partition part 33 of the close assistance piston 30, but is not limited thereto. The micro communication passage 311 may be formed by penetrating the inner side of the partition part 33 of the close assistance piston 30 and may be formed on the inner circumferential face of the needle valve close chamber 43 in the nozzle body 40.

In addition, in the present embodiment, the assistance force transmission part 32 of the close assistance piston 30 presses the rear end side of the needle valve 10, but is not limited thereto. A member may be provided between the close assistance piston 30 and the needle valve 10, through which the rear end side of the needle valve 10 is pressed. Furthermore, in the present embodiment, the uneven part 13 as the pressure receiver is formed at one part of the outer circumferential face of the needle valve main body 11, but is not limited thereto. The uneven part may be provided at, for example, a plurality of parts of the outer circumferential face at the front end side of the needle valve main body 11.

What is claimed is:

1. A fuel injection device comprising:

a nozzle body in which a first fuel chamber, a second fuel chamber, a third fuel chamber, and a nozzle orifice extending from the second fuel chamber to the outside of the fuel injection device are formed;

a needle valve held in a needle valve holding part in the nozzle body;

a needle valve open part provided closer to the front end side than the needle valve holding part in the nozzle body, having the second fuel chamber;

a needle valve close part provided closer to the rear end side than the needle valve holding part in the nozzle body, having the third fuel chamber;

an injection control valve held in the nozzle body, being capable of advancing and retreating in the first fuel chamber, in which in the nozzle body, a first fuel passage extending from a fuel supply source to the first fuel chamber, a second fuel passage extending from the first fuel chamber to the second fuel chamber, a third fuel passage extending from the first fuel chamber to the third fuel chamber, and a fourth fuel passage extending from the third fuel chamber to a low pressure part at the outside of the fuel injection device are formed, the injection control valve advances to a first position, thereby allowing the first fuel passage to be communicated with the first fuel chamber and blocking access from the first fuel chamber to the third fuel passage, and the injection control valve retreats to a second position, thereby blocking access from the first fuel passage to the first fuel chamber and allowing the first fuel chamber to be communicated with the third fuel passage, the needle valve advances to contact with the nozzle body, thereby blocking access from the second fuel chamber to the nozzle orifice, and the needle valve retreats to move apart from the nozzle body, thereby allowing the second fuel chamber to be communicated with the nozzle orifice, the needle valve open part retreats the needle valve by the fuel pressure in the second fuel chamber, and the needle valve close part advances the needle valve by the fuel pressure in the third fuel chamber; and a discharge prevention part of preventing fuel in the first fuel chamber from discharging to the outside of the fuel injection device through the third fuel passage, the third fuel chamber, and the fourth fuel passage when the injection control valve shifts from the first position to the second position.

2. The fuel injection device according to claim 1, wherein the needle valve close part is provided with a close assistance piston provided movably forward and rearward in the third fuel chamber, the close assistance piston blocks access from the third fuel passage to the third fuel chamber at a most retreated position and allows the third fuel passage to be communicated with the third fuel chamber by shifting to the advanced state, the third fuel chamber is divided into the close assistance pressure chamber communicated with the third fuel passage and the return pressure chamber communicated with the fourth fuel passage by the close assistance piston, in the advanced state of the close assistance piston, the close assistance piston is capable of transmitting the suppress strength generated by the fuel pressure in the close assistance pressure chamber in the forward direction to the needle valve, and the close assistance piston is the discharge prevention part of preventing fuel in the first fuel chamber from discharging to the outside of the fuel injection device by shifting from the advanced state to the most retreated position to block access from the third fuel passage to the close assistance pressure chamber, thereby preventing fuel in the first fuel chamber from flowing in the third fuel chamber through the third fuel passage.

3. The fuel injection device according to claim 2, wherein in the third fuel chamber, the rear end side of the needle valve is exposed, the needle valve close part is further provided with an elastic member that is provided between the close assistance piston and the rear end side of the needle valve and biases the close assistance piston and the needle valve in the direction in which the close assistance piston and the needle valve move apart from each other, and the close assistance piston is biased to the most retreated position by the elastic member.

4. The fuel injection device according to claim 3, wherein in the close assistance piston, a micro communication passage allowing the close assistance pressure chamber to be communicated with the return pressure chamber is formed.

5. The fuel injection device according to claim 4, wherein the micro communication passage is formed between the close assistance piston and the third fuel chamber by denting a part of the outer circumferential face of the close assistance piston.

6. The fuel injection device according to claim 2, wherein the close assistance piston is provided with an assistance force transmission part projecting in a rod shape from the end part of the needle valve side, the needle valve is provided with a needle valve main body with a rod shape, and a movement restriction part formed in a flange shape at the rear end side of the needle valve main body, restricting the needle valve from retreating, the needle valve advances when the assistance force transmission part of the close assistance piston presses the rear end side of the needle valve, and a space is formed between the close assistance piston and the needle valve when the close assistance piston retreats to the most retreated position, even if the needle valve retreats until the movement restriction part restricts the needle valve from retreating.

7. The fuel injection device according to claim 2, wherein the force by which the needle valve close part advances the needle valve is greater than that by which the needle valve open part retreats the needle valve when the injection control valve retreats from the first position to allow the second fuel passage to be communicated with the third fuel passage so that the fuel pressure in the second fuel chamber is equal to that in the third fuel chamber.

8. The fuel injection device according to claim 7, wherein the area of the pressure receiver for the fuel pressure which the needle valve close part receives from the third fuel chamber is greater than that of the pressure receiver for the fuel pressure which the needle valve open part receives from the second fuel chamber.

9. The fuel injection device according to claim 7, wherein the maximum diameter of the pressure receiver for the fuel pressure which the needle valve close part receives from the third fuel chamber is greater than that for the fuel pressure which the needle valve open part receives from the second fuel chamber.

10. The fuel injection device according to claim 7, wherein the needle valve open part consists of the second fuel chamber and an uneven part circularly formed along the outer circumference of the front end side of the needle valve, and the maximum diameter of the close assistance piston is greater than that of the uneven part of the needle valve open part.

11. A fuel injection device comprising:

a nozzle body in which a first fuel chamber is formed;

an injection control valve held in the nozzle body, being capable of advancing and retreating in the first fuel chamber, in which in the nozzle body, a first fuel passage extending from a fuel supply source to the first fuel chamber, an injected-fuel passage extending from the first fuel chamber to the nozzle orifice, and a return fuel passage extending from the first fuel chamber to a low pressure part at the outside of the fuel injection device are formed, the injection control valve advances to a first position, thereby allowing the first fuel passage to be communicated with the first fuel chamber and blocking access from the first fuel chamber to the return fuel passage, and the injection control valve retreats to a second position, thereby blocking access from the first fuel passage to the first fuel chamber and allowing the first fuel chamber to be communicated with the return fuel passage; and a discharge prevention part of preventing fuel in the first fuel chamber from discharging to the outside of the fuel injection device through the return fuel passage when the injection control valve shifts from the first position to the second position.

* * * * *